US008878036B2

(12) United States Patent
Winquist

(10) Patent No.: US 8,878,036 B2
(45) Date of Patent: Nov. 4, 2014

(54) DEVICE FOR MUTING THE SOUND OF A MUSICAL INSTRUMENT

(71) Applicant: Emilia Winquist, East Hampton, CT (US)

(72) Inventor: Emilia Winquist, East Hampton, CT (US)

( * ) Notice: Subject to any disclaimer, the term of this patent is extended or adjusted under 35 U.S.C. 154(b) by 31 days.

(21) Appl. No.: 13/737,305

(22) Filed: Jan. 9, 2013

(65) Prior Publication Data

US 2014/0190332 A1 Jul. 10, 2014

(51) Int. Cl.
*G10D 7/02* (2006.01)
*G10D 9/06* (2006.01)

(52) U.S. Cl.
CPC ..... *G10D 9/06* (2013.01)
USPC ..... 84/384; 84/360 R

(58) Field of Classification Search
USPC ..... 84/384
See application file for complete search history.

(56) References Cited

U.S. PATENT DOCUMENTS 2,807,182 A * 9/1957 Briggs ..... 84/400
3,715,448 A * 2/1973 Itoh ..... 84/375

* cited by examiner

*Primary Examiner* — Christopher Uhlir
(74) *Attorney, Agent, or Firm* — McCormick, Paulding & Huber, LLP

(57) ABSTRACT

The present application is directed to a muting device for muting the sound of musical instruments such as wind instruments, and more particularly, flutes. The muting device is configured to mute the sound of a wind instrument by restricting the airflow through the blowhole of the wind instrument without changing the pitch of the sound produced by the wind instrument. The muting device may restrict the airflow through the blowhole of the wind instrument by means of a woven or knitted mesh fabric placed over the blowhole of the wind instrument.

17 Claims, 3 Drawing Sheets

DEVICE FOR MUTING THE SOUND OF A MUSICAL INSTRUMENT

FIELD OF THE INVENTION

The present invention is directed to a device for muting the sound of a wind instruments, particularly flutes.

BACKGROUND

Learning to play a musical instrument, such as a flute, requires practice playing the instrument. Unfortunately, some people may be disturbed by the sound of a person playing an instrument. As a result, a person playing an instrument may be asked to stop by persons disturbed by the sound of the instrument, or may be apprehensive about playing the instrument for fear of disturbing others. Accordingly, it would be advantageous to provide a means for temporarily muting the sound of an instrument, such as a flute, so that a person may practice playing an instrument without disturbing others, and preserve the ability to play the instrument without muting its sound after the person is done practicing. The inventor found that certain means of muting a wind instrument altered the pitch of the sound produced by the instrument. For example, modifying the size of the blowhole of a wind instrument was found to change the pitch of the sound produced.

SUMMARY OF THE INVENTION

The present application is directed to a muting device for muting the sound of musical instruments such as wind instruments, and more particularly, flutes. The muting device is configured to mute the sound of a wind instrument by restricting the airflow through the blowhole of the wind instrument without changing the pitch of the sound produced by the wind instrument. The muting device may restrict the airflow through the blowhole of the wind instrument by means of a woven or knitted elastic mesh fabric, or other suitable sheet or film of porous material, placed over the blowhole of the wind instrument.

In one embodiment, the muting device may comprise a mesh fabric configured in a tubular shape dimensioned such that the mesh fabric can be stretched taut around the head of the wind instrument to cover the blowhole.

In another embodiment, the muting device may comprise a mesh fabric and one or more clips configured to clip onto the body of the wind instrument and secure the mesh fabric to the body of the wind instrument while the mesh fabric is stretched taut over the blow hole of the wind instrument In a further embodiment, the muting device may comprise a mesh fabric supported on a frame that is configured to clip onto the wind instrument such that the frame extends around the blowhole of the wind instrument and the mesh fabric extends over the blowhole of the wind instrument.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings embodiments that are presently preferred, it being understood, however, that the invention is not limited to the specific embodiments disclosed. In the drawings.

DETAILED DESCRIPTION

Before the various embodiments are described in further detail, it is to be understood that the invention is not limited to the particular embodiments described. It is also to be understood that the terminology used is for the purpose of describing particular embodiments only, and is not intended to limit the scope of the claims of the present application.

As shown in the exemplary embodiments illustrated in the Figures, the present application is directed to a muting device 1 for muting the sound of musical instruments such as wind instruments, and more particularly, flutes. The muting device 1 is configured to mute the sound of a wind instrument 2 by restricting the airflow through the blowhole 20 of the wind instrument 2 without changing the pitch of the sound produced by the wind instrument 2. The muting device 1 may restrict the airflow through the blowhole 20 of the wind instrument 2 by means of a woven or knitted mesh fabric 10, or other suitable sheet or film of porous material, placed over the blowhole 20 of the wind instrument 2.

Figure 1A:
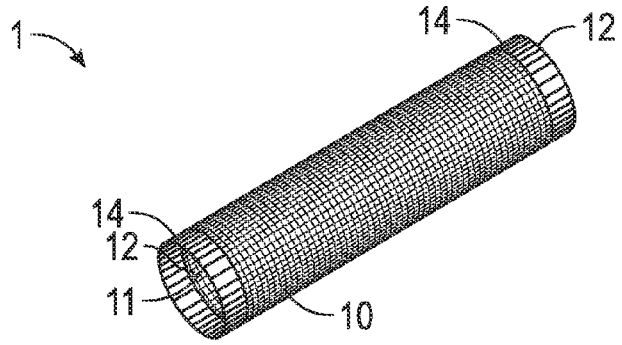
FIG. 1A shows an exemplary embodiment of a muting device.
Figure 1B:
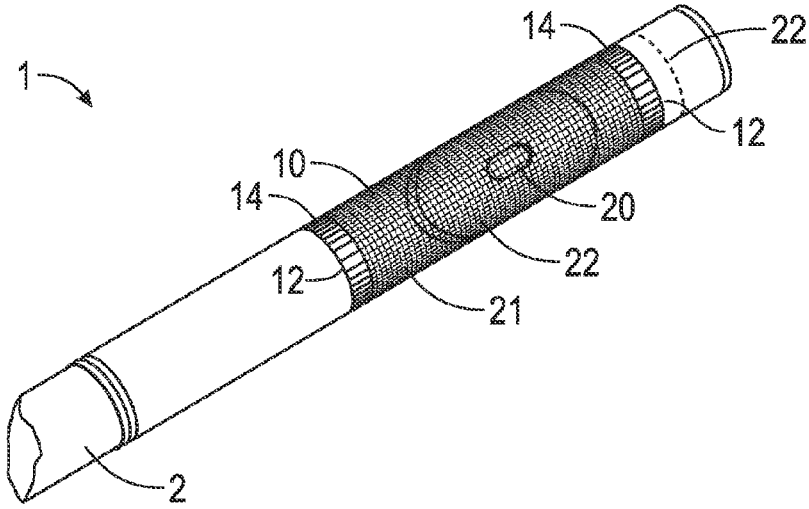
FIG. 1B shows the muting device shown in FIG. 1A attached to a flute.
Figure 1C:
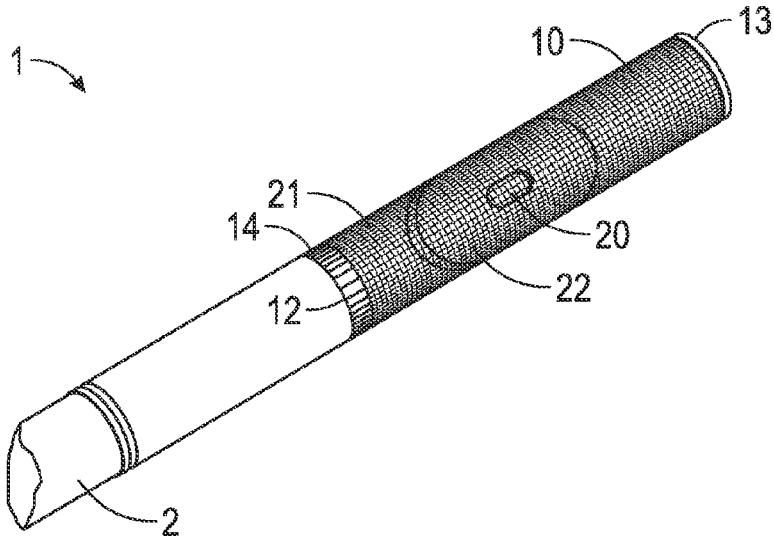
FIG. 1C shows an alternative embodiment of the muting device shown in FIGS. 1A-1B attached to a flute.

As shown in one exemplary embodiment illustrated in FIGS. 1A-1B, the muting device 1 may comprise a mesh fabric 10 configured in a tubular shape. The tubular shape of the mesh fabric 10 may be preferably dimensioned such that the mesh fabric can be stretched taut around the head 21 of the wind instrument 2 to cover the blowhole 20. In particular, the circumferential dimension 11 of the tubular shape of the mesh fabric 10 at rest may be less than the circumferential dimension 22 of head 21 of the wind instrument 2. As shown in FIGS. 1A and 1B the mesh fabric 10 may have a tubular shape defining two open ends 12, such that the tubular shaped mesh fabric 10 can be slipped over the head 21 of the wind instrument 2 to cover the blow hole 20. In an alternative embodiment, illustrated in FIG. 1C, the mesh fabric 10 may have a tubular shape defining one open 12 end and one closed end 13, such that the open end 12 can be slipped over the head 21 of the wind instrument 2 and the closed end 12 prevents the tubular shaped mesh fabric 10 from slipping further along the head 21 of the wind instrument 2. Further, in some embodiments, a non-slip material 14 (e.g., rubber) may be adhered to an inner surface of the open end(s) 12 of the tubular shaped mesh fabric 10 so that the mesh fabric 10 can be secured on the head 21 of the wind instrument 2. As shown, the muting device 1 is designed to be removably attached so that the muting device can be easily removed once muting is no longer desired.

Figure 2A:
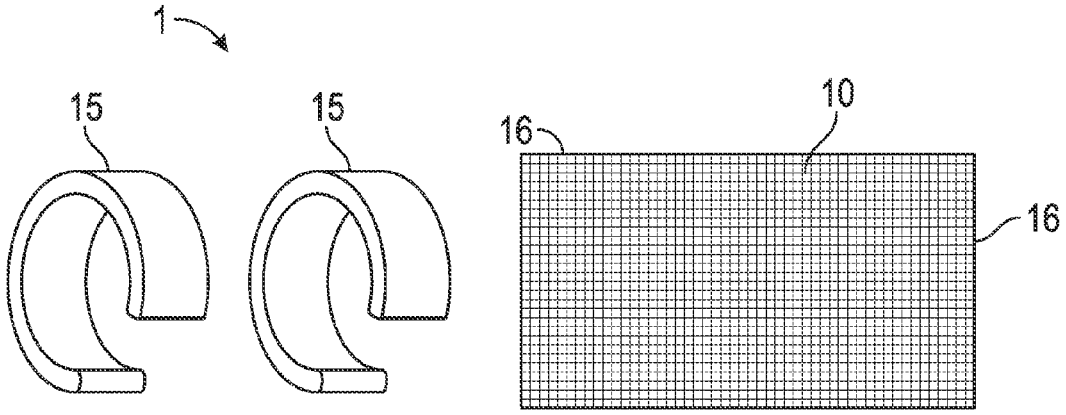
FIG. 2A shows another exemplary embodiment of a muting device.
Figure 2B:
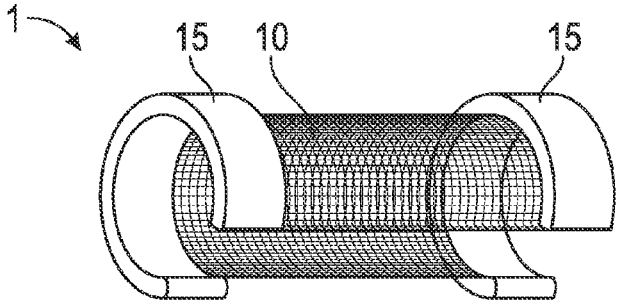
FIG. 2B shows an alternative embodiment of the muting device shown in FIG. 2A.
Figure 2C:
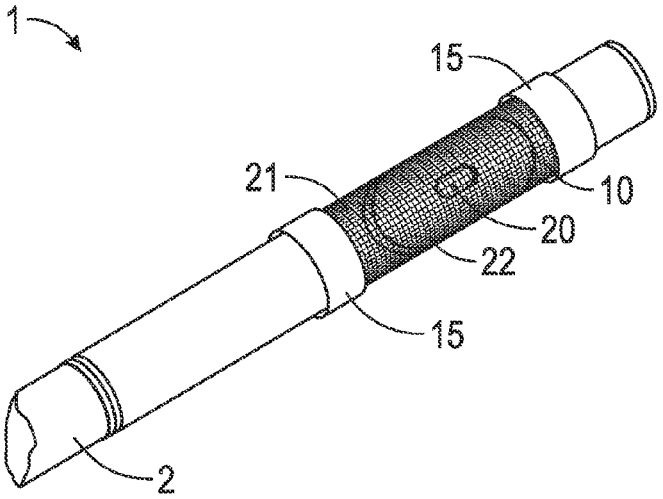
FIG. 2C shows the muting device shown in FIG. 2A-2B attached to a flute.

As shown in another exemplary embodiment illustrated in FIGS. 2A-2C, the muting device 1 may comprise a mesh fabric 10 and one or more clips 15. As shown, the mesh fabric 10 may be placed over the blowhole 20 of the wind instrument 2 and held in place by the one or more clips 15. As shown in FIGS. 2A-2C, the clips 15 may be adapted to clip onto the head 21 of a wind instrument 2 and secure the mesh fabric 10 over the blowhole 20 of the wind instrument 2. More particularly, the clips 15 may have a semi-circular or semi-cylindrical shape dimensioned to match the cylindrical outer contour of the head 21 of the wind instrument 2 such that the clips 15 can be properly secured to the wind instrument 2. The clips 12 may be made of any suitable material that provides sufficient rigidity to secure the mesh fabric 10 to the wind instrument 2, but also sufficient flexibility to allow the clips 15 to be clipped onto the wind instrument 2. For example, the clips 15 may be made of a suitable material such as plastic, metal, etc.

As shown in FIGS. 2A-2C, the mesh fabric 10 may have a substantially rectangular shape dimensioned to cover the blow hole 20 of the musical instrument 2 and extend around the blow hole 20 such that the mesh fabric 10 can be secured to the head 21 of the wind instrument 2 using clips 15. Further, in some embodiments, a non-slip material 14 (e.g., rubber) may be adhered to a surface of the mesh fabric 10 so that the mesh fabric 10 can be secured on the head 21 of the wind instrument 2. Also, although not shown in the Figures, the one or more clips 15 shown in FIGS. 2A-2C may be used with the tubular-shaped mesh fabric 10 shown in FIGS. 1A-1C to secure the open end(s) 12 of the tubular-shaped mesh fabric 10 to the head 21 of the wind instrument 2.

As shown in FIG. 2A, the mesh fabric 10 may be attached to one or more clips 15, such that when the one or more clips 15 are attached to the head 21 of the wind instrument 2, the mesh fabric 10 may be held in place while stretched taut over the blow hole 20 of the instrument 2. More particularly, the mesh fabric 10 may have a substantially rectangular shape defining two ends 16, which are each attached to clips 15. The mesh fabric 10 may be attached to the clips 15 by any conventional bonding means (e.g., glue). Alternatively, as shown in FIG. 2B, the mesh fabric 10 may not be attached to one or more clips 15, such that the mesh fabric 10 can be separately placed over the blow hole 20 of the wind instrument 2 and then secured in place by using the one or more clips 15. As shown, the muting device 1 is designed to be removably attached so that the muting device can be easily removed once muting is no longer desired.

Figure 3A:
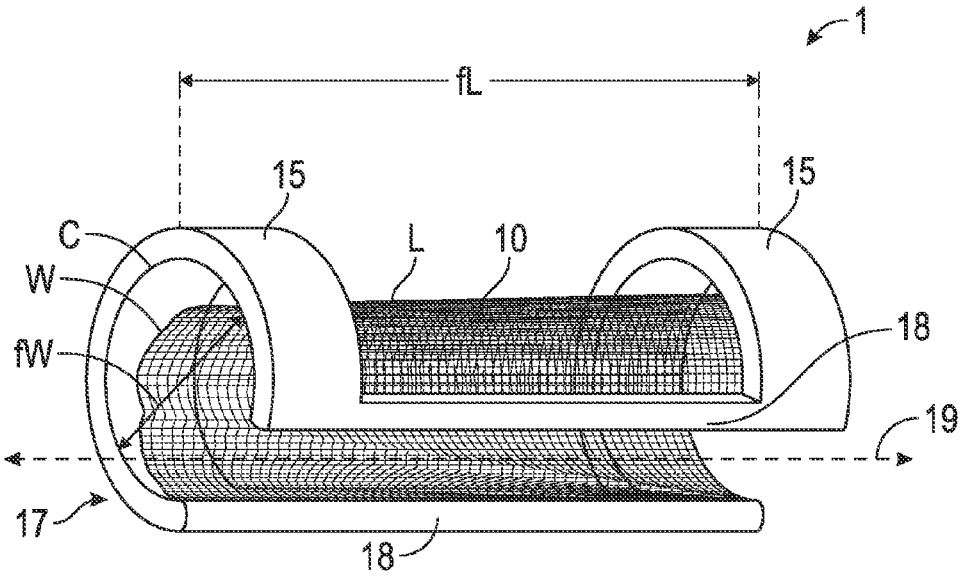
FIG. 3A shows another exemplary embodiment of a muting device.
Figure 3B:
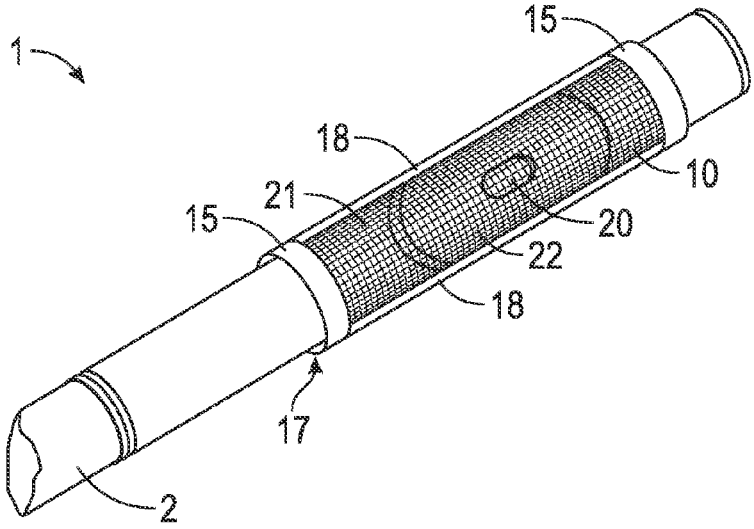
FIG. 3B shows the muting device shown in FIG. 3A attached to a flute.

As shown in another exemplary embodiment illustrated in FIGS. 3A-3B, the muting device 1 may comprise the mesh fabric 10 supported on a frame 17 that is configured to clip onto the wind instrument 2 such that the frame 17 extends around the blow hole 20 of the wind instrument 2 and the mesh fabric 10 extends over the blow hole 20 of the wind instrument 2. The frame 17 may be preferably configured to clip onto the wind instrument 2 so that the muting device 1 may be easily attached to and detached from the wind instrument 2. Further, the frame 17 may be preferably configured to not interfere with the playing of the wind instrument 2. For example, the frame 17 may be configured to extend around the blowhole 20 of the wind instrument 2 such that the frame 17 does not interfere with the placement of a player's mouth/lips around the blowhole 20 of the wind instrument 2. More particularly, for a muting device 1 configured for use with a flute as shown in the exemplary embodiment illustrated in the Figures, the frame 17 may be configured to extend around the lip plate 22 of the flute 2, so as to not interfere with the placement of the flute player's lip on the lip plate 22.

As shown in the exemplary embodiment illustrated in FIGS. 3A-3B, the frame 17 may comprise two semi-circular or semi-cylindrical clips 15, which are connected together and spaced apart by two struts 18 along a longitudinal axis 19. The clips 15 may have a two semi-circular or semi-cylindrical shape dimensioned to match the cylindrical outer contour of the head 21 of the wind instrument 2 such that the clips 15 can be properly secured to the wind instrument 2. The clips 15 may be made of any suitable material that provides sufficient rigidity to secure the mesh fabric to the wind instrument, but also sufficient flexibility to allow the clips to be clipped onto the wind instrument. For example, the clips 15 may be made of a suitable material such as plastic, metal, etc. The struts 18 connecting the two clips 15 may be made of the same material as the clips 15 and integrally formed with the clips 15. Alternatively, the struts 18 may be made of a different material than the clips 15 and separately formed.

As shown in FIGS. 3A-3B, the mesh fabric 10 may be preferably configured such that it does not interfere with the playing of the wind instrument 2. For example, the mesh fabric 10 may be preferably dimensioned and attached to the struts 18 of the frame 17 such that when the muting device 1 is attached to the wind instrument 2, the mesh fabric 10 is stretched taut over the blowhole 20 of the wind instrument 2. The mesh fabric 10 may be attached to the struts 18 of the frame 17 by any conventional bonding means (e.g., glue). More particularly, the mesh fabric 10 may have a substantially rectangular shape having a length (L) and a width (W), where the struts 18 attach to mesh fabric 10 along the length (L) of the mesh fabric 10 and the width (W) of the mesh fabric 10 between the struts 18 is shorter than the circumferential dimension (C) of the semi-circular or semi-cylindrical clips 15. The mesh fabric spans across some portion of the width of the frame (fW) and some portion of the length of the frame (fL) such that when the muting device 1 is clipped onto the head 21 of the instrument 2, the mesh fabric 10 extends over and covers the blowhole 20. Thus, when the frame 17 is clipped onto the head 21 of the wind instrument 2, the mesh fabric 10 is stretched at least along the width (W) of the mesh fabric 10. As shown, the muting device is designed to be removably attached so that the muting device can be easily removed once muting is no longer desired.

For all of the embodiments of the muting device 1, the mesh fabric 10 may be preferably flexible and elastic, so that the mesh fabric 10 adapts to the shape of the wind instrument 2 when the mesh fabric 10 is stretched taut over the blowhole 20 of the instrument 2. Thus, the mesh fabric 10 is adapted to not bunch up and block the blowhole 20 of the wind instrument 2 or significantly affect the feel of the instrument 2 on the player's mouth/lip. Further, the mesh fabric 10 is adapted to restrict the flow of air through the blow hole of the wind instrument, thereby muting the sound produced by the wind instrument without changing the pitch of the sound produced. The mesh fabric 10 may be preferably a sheer stretch mesh fabric, such as for example, a sheer knit fabric preferably made of nylon, polyester, spandex or some blend of one or more of these materials. For instance, one suitable mesh fabric is the type of elastic fabric material conventionally used to make pantyhose.

Alternatively, other suitable sheet or film of porous material may be placed over the blowhole 20 of the wind instrument 2 to mute the sound of the wind instrument 2 by restricting the airflow through the blowhole 20 without changing the pitch of the sound produced by the wind instrument 2. For example, thin sheets of foam material, plastic mesh, or metal mesh may be suitable.

Advantageously, the muting devices 1 described in the present application are not disposed inside the air passage of a wind instrument 2 so they can be easily attached/detached to a wind instrument, such as flute. Further, the muting devices 1 described in the present application do not significantly alter the feel of playing the instrument 2. Further, because the muting devices 1 described in the present application restrict the airflow through the blowhole 20 by means of a mesh fabric 10, or other suitable sheet or film of porous material, rather than by altering the effective size of the blowhole 20, the sound of the instrument 2 is muted without changing the pitch of the sound produced.

While various embodiments have been described, it will be appreciated by those of ordinary skill in the art that modifications can be made to the various embodiments without departing from the spirit and scope of the invention as a whole.

What is claimed is:

1. A device for muting the sound of a wind instrument having a body and a blow hole, the device comprising:

a frame configured to clip on the body of the wind instrument and extend around the blowhole of the wind instrument, the frame having a width and a length;

a mesh fabric attached to the frame, the mesh fabric spanning across some portion of the width of the frame and some portion of the length of the frame such that when the device is clipped onto the body of the wind instrument, the mesh fabric extends over and covers the blowhole of the wind instrument.

2. The device according to claim 1, wherein the frame comprises:

two semi-cylindrical clips spaced apart from each other; and two struts connecting the two semi-cylindrical clips and extending along the length of the frame;

wherein the mesh fabric is attached to the two struts of the frame.

3. The device according to claim 1, wherein the mesh fabric is a sheer stretch mesh fabric.

4. The device according to claim 3, wherein the sheer stretch mesh fabric is a knit fabric made of at least one of nylon, polyester and spandex.

5. A device for muting the sound of a wind instrument having a body and a blow hole, the device comprising a mesh fabric configured in an elongated tubular shape; wherein the elongated tubular shape of the mesh fabric is adapted to be slipped over and stretched taut over the body of the wind instrument to cover the blow hole for practice, and removed from the wind instrument thereafter.

6. The device according to claim 5, wherein the mesh fabric is a sheer stretch mesh fabric.

7. The device according to claim 6, wherein the sheer stretch mesh fabric is a knit fabric made of at least one of nylon, polyester and spandex.

8. The device according to claim 5, wherein the elongated tubular shape of the mesh fabric defines two open ends.

9. The device according to claim 5, wherein the elongated tubular shape of the mesh fabric defines one open end.

10. The device according to claim 8 further comprising a non-slip material disposed on an inner surface of the elongated tubular shape of the mesh fabric at the two open ends.

11. The device according to claim 9 further comprising a non-slip material disposed on an inner surface of the elongated tubular shape of the mesh fabric at the one open end.

12. The device according to claim 5 further comprising one or more clips configured to clip onto the body of the wind instrument and secure the mesh fabric to the wind instrument.

13. A device for muting the sound of a wind instrument having a body and a bloc hole, the device comprising:

a mesh fabric; and two or more clips configured to clip onto the body of the wind instrument and secure the mesh fabric to the body of the wind instrument while the mesh fabric is stretched taut over the blow hole of the wind instrument.

14. The device according to claim 13, wherein the mesh fabric is attached to the two or more clips.

15. The device according to claim 13 further comprising a non-slip material disposed on a surface of the mesh fabric.

16. The device according to claim 13, wherein the mesh fabric is a sheer stretch mesh fabric.

17. The device according to claim 16, wherein the sheer stretch mesh fabric is a knit fabric made of at least one of nylon, polyester and spandex.

* * * * *

UNITED STATES PATENT AND TRADEMARK OFFICE

CERTIFICATE OF CORRECTION

PATENT NO. : 8,878,036 B2
APPLICATION NO. : 13/737305
DATED : November 4, 2014
INVENTOR(S) : Emilia Winquist It is certified that error appears in the above-identified patent and that said Letters Patent is hereby corrected as shown below:

In the Claims:

Claim 13, Column 6, line 23, "(bloc hole,)" should be replaced with --(blow hole,)--.

Signed and Sealed this
Tenth Day of February, 2015

Michelle K. Lee

Michelle K. Lee
*Deputy Director of the United States Patent and Trademark Office*